United States Patent [19]

Derks

[11] Patent Number: 5,030,879

[45] Date of Patent: Jul. 9, 1991

[54] CATHODE FOR AN ELECTRIC DISCHARGE TUBE

[75] Inventor: Petrus J. A. M. Derks, Eindhoven, Netherlands

[73] Assignee: U.S. Philips Corporation, New York, N.Y.

[21] Appl. No.: 503,333

[22] Filed: Mar. 30, 1990

[30] Foreign Application Priority Data

Apr. 3, 1989 [NL] Netherlands ..... 8900806

[51] Int. Cl.[5] ..... H01J 1/13; H01J 1/14

[52] U.S. Cl. ..... 313/346 R; 313/337; 313/270

[58] Field of Search ..... 313/270, 337, 346 R

[56] References Cited

U.S. PATENT DOCUMENTS 3,958,146 5/1976 Buescher et al. ..... 313/337

FOREIGN PATENT DOCUMENTS 59-149622 8/1984 Japan ..... 313/346 R

*Primary Examiner*—Donald J. Yusko
*Assistant Examiner*—Nimeshkumar D. Patel
*Attorney, Agent, or Firm*—John C. Fox

[57] ABSTRACT

Cathode for an electric discharge tube having a short warm-up time and a long lifetime. The cathode comprises a metal (particularly nickel) support base coated with a layer of potentially electron-emissive material, which support base has a thickness ranging between 20 and 150 μm, and metal crystallites having a size which does not permit of any further crystallite growth or recrystallization. Preferably, the crystallites of the support base have a size which corresponds to the thickness of the support base.

9 Claims, 1 Drawing Sheet

CATHODE FOR AN ELECTRIC DISCHARGE TUBE

BACKGROUND OF THE INVENTION

The invention relates to a cathode for an electric discharge tube, comprising a metal support base coated with a layer of potentially electron-emissive material.

In the manufacture of cathodes for electron tubes a basic composition is usually formed to a desired configuration and then coated with a layer of alkaline earth carbonates in order to form a cathode. Subsequently the cathode is placed in an electron tube structure and heat is directly or indirectly applied to the cathode so as to reduce the carbonates to oxides and free metal and thereby activate the cathode. Subsequently heat is applied to the cathode during operation of the tube in order to realize emission of electrons during a period (=lifetime) and to an extent which is dependent on a large number of factors. A relatively thick support base has appeared to be favourable, for example for a long lifetime. A drawback of a relatively thick support base is, however, that the cathode has a long heating time, which is undesirable in many applications.

OBJECT AND SUMMARY OF THE INVENTION

The invention has for its object to provide a cathode having a short heating time and yet a long lifetime.

According to the invention a cathode of the type described in the opening paragraph is therefore characterized in that the support base has a thickness ranging between 20 and 150 μm, the metal crystallites in the base having a size which does not permit any further crystallite growth or recrystallization.

The invention is based on the recognition that the temperature conditions which prevail in an electron tube during operation may cause grain growth or recrystallization of the grains of the support base, which grain growth or recrystallization in its turn causes the electron-emissive coating to scale or come off in the case of a relatively thin support base. This is a factor which detrimentally influences the lifetime of the cathode. The lifetime of a cathode having a relatively thin support base and hence a short heating time can be improved considerably by ensuring that the metal crystallites have a size which no longer permits grain growth or recrystallization.

Generally, grain growth or recrystallization is not possible if the metal crystallites have a size which corresponds to the thickness of the support base. An embodiment of the cathode according to the invention is therefore characterized in that the crystallites of the support base have a size which corresponds to the thickness of the support base.

During operation the cathode according to the invention can be heated directly or indirectly (by means of heat generated by a separate heating body, for example a filament). In the latter case it is advantageous for the stability of the thin support base if the heating body remains free from contact with the support base during operation of the cathode. Otherwise, the heating body may detrimentally influence the stability of this base, particularly in the case where it is continuously switched on and off during operation.

The favourable effect on the cathode lifetime caused by crystallites which cannot exhibit any further crystal growth could thereby be annihilated to a partial extent.

The heating body is preferably placed at a distance ranging between 20 and 300 μm from the support base. If the distance is smaller than 20 μm, the heating base and the support body may still come into contact with each other during use of the cathode due to thermal expansion of the heating body. If the distance is larger than 300 μm, the support body is less efficiently heated by the heating body.

In the manufacture of a support base for a cathode it is common practice to combine specific additives (such as Mg, Si and Al) and a base material (such as nickel, nickel alloys such as nickel-lanthanum and tungsten) by means of a melting process so as to obtain a cathode support base material. This material is hot-rolled, then cold-rolled to a strip having a desired thickness and subsequently formed to a cathode support base configuration. The crystals of the support base can be given the desired size which does not permit any further grain growth by giving, according to a further aspect of the invention. the support base a suitable recrystallization thermal treatment prior to the formation of the cathode.

The invention is also based on the recognition that the decrease of the electron emission during the lifetime of the cathode results, inter alia , from the reduction of the quantity of emission activators in the support body, notably in the surface of the support body, due to diffusion and oxidation of the activators. These activators are constituted by the additions which are present in the support body. The activators diffuse during use of the cathode to the surface of the support body where they activate the electron emission.

Particularly in thin supports, which in total comprise a smaller quantity of additions, hence activators, it is thus important that these activators are not rendered partly or totally "inactive" by the thermal treatment which is performed to obtain a maximum size of the crystals. A further aspect of the invention is therefore characterized in that the recrystallization thermal treatment is performed under conditions which prevent additions in the metal of the support base from forming oxides to a depth further than 1 micrometer from the surface, and preferably further than 0.5 micrometer.

If the support body is heated in a dry hydrogen atmosphere at a temperature between 850° C. and 1100°C., optionally preceded by a thermal treatment in an oxygen-containing atmosphere at a temperature ranging between 300° C. and 450° C., it not only appears that the nickel in the support body recrystallizes to a sufficient extent but also that only a very small quantity of activators becomes inactive. As a result the cathode has a sufficiently constant emission of electrons during its lifetime. Moreover, the cathode appears to be improved in a number of zero-hour emission properties such as an increase of the saturation current, because the free activator elements are present near the surface of the support body.

BRIEF DESCRIPTION OF THE DRAWING

An embodiment of the invention will now be described in greater detail by way of example with reference to the accompanying drawing in which.

DESCRIPTION OF THE PREFERRED EMBODIMENT

Figure 1:
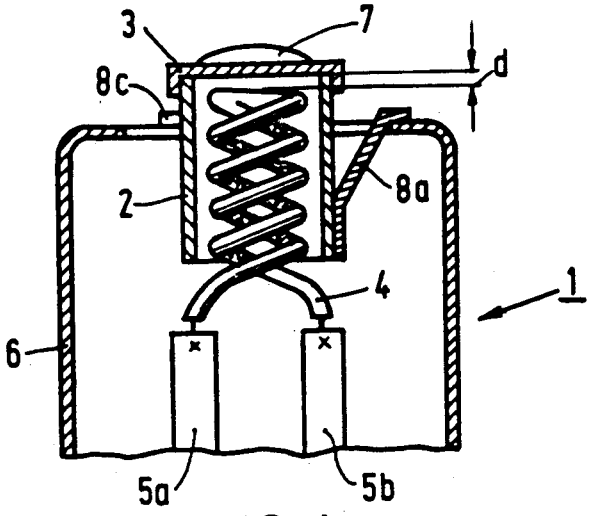
FIG. 1 is a diagrammatic longitudinal section view of an indirectly heated cathode assembly.

The cathode 1 of FIG. 1 has a cylindrical nickel-chromium cathode support shaft 2, which is provided with a support base or support body 3. The support body 3 mainly consists of nickel and may comprise free activator elements such as, for example Cr, Mg, Al, W, Ta, Si, Ti, Co, Mn and Zr. The cathode shaft 2 accommodates a heating body in the form of a helical filament 4 which may consist of a helically wound metal core having an electrically insulating aluminum oxide coating. A layer of potentially electron-emissive material 7, which is several dozen micrometers thick and which may be provided, for example by means of spraying, is present on the support body 3.

When the manufacturing such a cathode the support body 3 is secured to the cathode shaft 2 during a process step. According to the invention, the support body is subjected to a thermal treatment before it is secured to the cathode shaft. The support body is initially heated in air for 10 to 20 minutes at a temperature of between 300° C. and 450° C. in order to oxidize organic compounds. Subsequently the support body is heated in a dry hydrogen atmosphere (dew point −60° C.) for 10 to 20 minutes at a temperature of between 850° C. and 1100° C. As a result of this latter heating step, the nickel crystals grow to their maximum size in the support body so that problems of bonding the emissive layer to the support body are prevented from occurring at a later stage, for example, when activating the cathode, during which temperatures up to 1000° C. may occur. After the above-described treatment the support body has a glossy appearance.

The cathode shaft may be bright or it may be provided with a thermally black radiating layer. For example, by a separate thermal treatment so as to obtain such a layer on the inner side and the outer side of the cathode shaft. An example of a suitable thermal treatment of a cathode shaft consisting of a chromium-nickel alloy is to heat the cathode shaft in a dry hydrogen atmosphere at a temperature of approximately 950° C. which contaminations on the surface are removed. Subsequently the cathode shaft is heated in air at a temperature of approximately 700° C., to form chromium oxide and nickel oxide crystals on the surface. By subsequently heating the cathode shaft in a humid hydrogen atmosphere (dew point 14° C.) at 1050° C., the nickel oxide which has formed on the support body is reduced to nickel, while the chromium oxide is not reduced. Since the humid hydrogen atmosphere has an oxidizing effect on chromium, the chromium oxide film on the shaft will become thicker during this thermal treatment ultimately forming a stable thermally black radiating layer.

After all thermal treatments of the support body 3 and the cathode shaft 2 they are secured to each other, for example, by means of welding.

During a subsequent process step a layer of potentially electron-emissive material is provided on the support body.

It has been found that the reduction of electron emission of the layer which always occurs during the lifetime of the cathode may be kept very small (in a given case no more than 8% as against a reduction of more than 25% in conventional cathodes) when the support body is subjected to the previously mentioned thermal treatment so as to give the metal crystals a maximum size. Moreover, a number of zero-hour emission properties of the cathode also appear to be improved.

Figure 2:
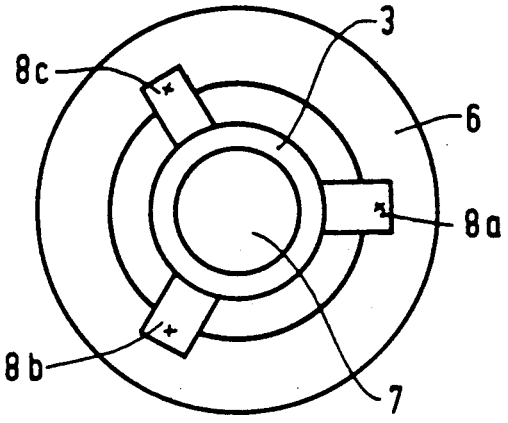
FIG. 2 is a plan view of the assembly of FIG. 1.

The cathode shaft 2 with the support base 3 of the cathode 1 of FIG. 1 is suspended in an opening of a housing 6 by three suspension means 8*a*, 8*b* and 8*c* (see FIG. 2). The filament 4 is connected to current supply leads 5*a* and 5*b*.

Figure 3:
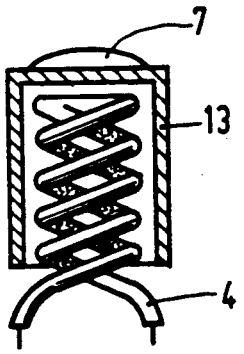
FIG. 3 is a longitudinal section view of another cathode assembly having an alternative support base structure.

FIG. 3 shows an alternative construction in which the shaft and the support base consist of one piece 13. The emissive layer 7 and the filament 4 are the same as in FIG. 1.

In both cases it is advantageous for the lifetime of the cathode when the filament 4 cannot come into contact with the thin (20–150 μm thick) support base 3 or 13. The filament 4 is preferably placed in the cathode shaft 2 in such a way that the distance d (FIG. 1) between the support body 3 and the filament 4 ranges between 20 μm and 300 μm. Dependent on the permissible lower cathode temperature, the distance d is preferably between 50 and 200 μm.

A cathode according to the invention not only has a substantially constant electron emission during its lifetime but it can also be operated at a lower temperature due to its increased zero-hour emission.

I claim:

1. A cathode for an electric discharge tube, comprising a metal support base having metal crystallites and coated with a layer of potentially electron-emissive material, characterized in that the support base has a thickness ranging between 20 and 150 μm, and the metal crystallites of the support base have a size which does not permit any further crystallite growth or recrystallization.

2. A cathode as claimed in claim 1, characterized in that the crystallites of the support base have a size which corresponds to the thickness of the support base.

3. A cathode as claimed in claim 1, characterized in that the support body mainly comprises nickel.

4. A cathode as claimed in claim 1, characterized in that it also comprises a heating body which is free from contact with the support base.

5. A cathode ray tube comprising a cathode as claimed in claim 1.

6. A cathode as claimed in claim 2, characterized in that the support body mainly comprises nickel.

7. A cathode ray tube comprising a cathode as claimed in claim 2.

8. A cathode ray tube comprising a cathode as claimed in claim 3.

9. A cathode ray tube comprising a cathode as claimed in claim 4.

* * * * *